US006247572B1

(12) United States Patent
Neborsky et al.

(10) Patent No.: US 6,247,572 B1
(45) Date of Patent: Jun. 19, 2001

(54) BILL VALIDATOR STATUS DETECTOR

(75) Inventors: Francis L. Neborsky, East Lyme; James P. Brennan, Colchester; Kevin R. Fletcher, Dayville, all of CT (US)

(73) Assignee: Mohegan Tribal Gaming Authority, Uncasville, CT (US)

( * ) Notice: Subject to any disclaimer, the term of this patent is extended or adjusted under 35 U.S.C. 154(b) by 0 days.

(21) Appl. No.: 09/390,413

(22) Filed: Sep. 3, 1999

(51) Int. Cl.[7] ..... G07D 7/00
(52) U.S. Cl. ..... 194/200; 194/206
(58) Field of Search ..... 194/200, 201, 194/206, 203; 463/25

(56) References Cited

U.S. PATENT DOCUMENTS

| | | | |
|---|---|---|---|
| 4,470,496 | 9/1984 | Steiner | 209/534 X |
| 5,113,990 | 5/1992 | Gabrius et al. | 194/206 |
| 5,222,583 | 6/1993 | Bergmann et al. | 194/206 |
| 5,544,728 | 8/1996 | Dabrowski | 194/206 |
| 5,611,730 | 3/1997 | Weiss | 463/20 |
| 5,752,882 | 5/1998 | Acres et al. | 463/42 |
| 5,826,680 | 10/1998 | Takemoto et al. | 186/37 |

*Primary Examiner*—F. J. Bartuska
(74) *Attorney, Agent, or Firm*—Cantor Colburn LLP

(57) ABSTRACT

An exemplary embodiment of the invention is a system for detecting the status of a bill validator in a gaming device. The system includes a credit detector for receiving a signal from the gaming device and generating a credit detector signal indicating whether the gaming device has one or more credits. A bill validator enable detector receives a signal from the gaming device and generates a bill validator enable signal indicating the status of the bill validator. A coin lockout detector receives a signal from the gaming device and generates a coin lockout signal indicating whether the gaming device is ready for play. A logic unit generates an error signal indicative of a malfunction in the bill validator in response to the credit detector signal, the bill validator enable signal and the coin lockout signal.

9 Claims, 2 Drawing Sheets

| A | B | C | X |
|---|---|---|---|
| 0 | 0 | 0 | 0 |
| 0 | 0 | 1 | 1 |
| 0 | 1 | 0 | 0 |
| 0 | 1 | 1 | 0 |
| 1 | 0 | 0 | 0 |
| 1 | 0 | 1 | 0 |
| 1 | 1 | 0 | 0 |
| 1 | 1 | 1 | 0 |

FIG. 2

BILL VALIDATOR STATUS DETECTOR

BACKGROUND OF THE INVENTION

The invention relates to a bill validator status detector for detecting the status of a bill validator in a device such as a gaming device. Gaming devices, such as slot machines, often include a bill validator allowing a customer to use either coins or bills to wager. Bill validators can experience failures which must be corrected by service personnel. When the bill validator is inoperative, customers cannot use bills to play the gaming device which results in customer frustration and reduced revenue. Accordingly, it is desirable to decrease the number of non-working bill validators and decrease the amount of bill validator down time.

SUMMARY OF THE INVENTION

An exemplary embodiment of the invention is a system for detecting the status of a bill validator in a gaming device. The system includes a credit detector for receiving a signal from the gaming device and generating a credit detector signal indicating whether the gaming device has one or more credits. A bill validator enable detector receives a signal from the gaming device and generates a bill validator enable signal indicating the status of the bill validator. A coin lockout detector receives a signal from the gaming device and generates a coin lockout signal indicating whether the gaming device is ready for play. A logic unit generates an error signal indicative of a malfunction in the bill validator in response to the credit detector signal, the bill validator enable signal and the coin lockout signal.

BRIEF DESCRIPTION OF THE DRAWINGS

Referring now to the drawings wherein like elements are numbered alike in the several FIGURES:

FIG. 2 is a truth table for a logic unit in the bill validator status detector.

DETAILED DESCRIPTION OF THE PREFERRED EMBODIMENTS

Figure 1:
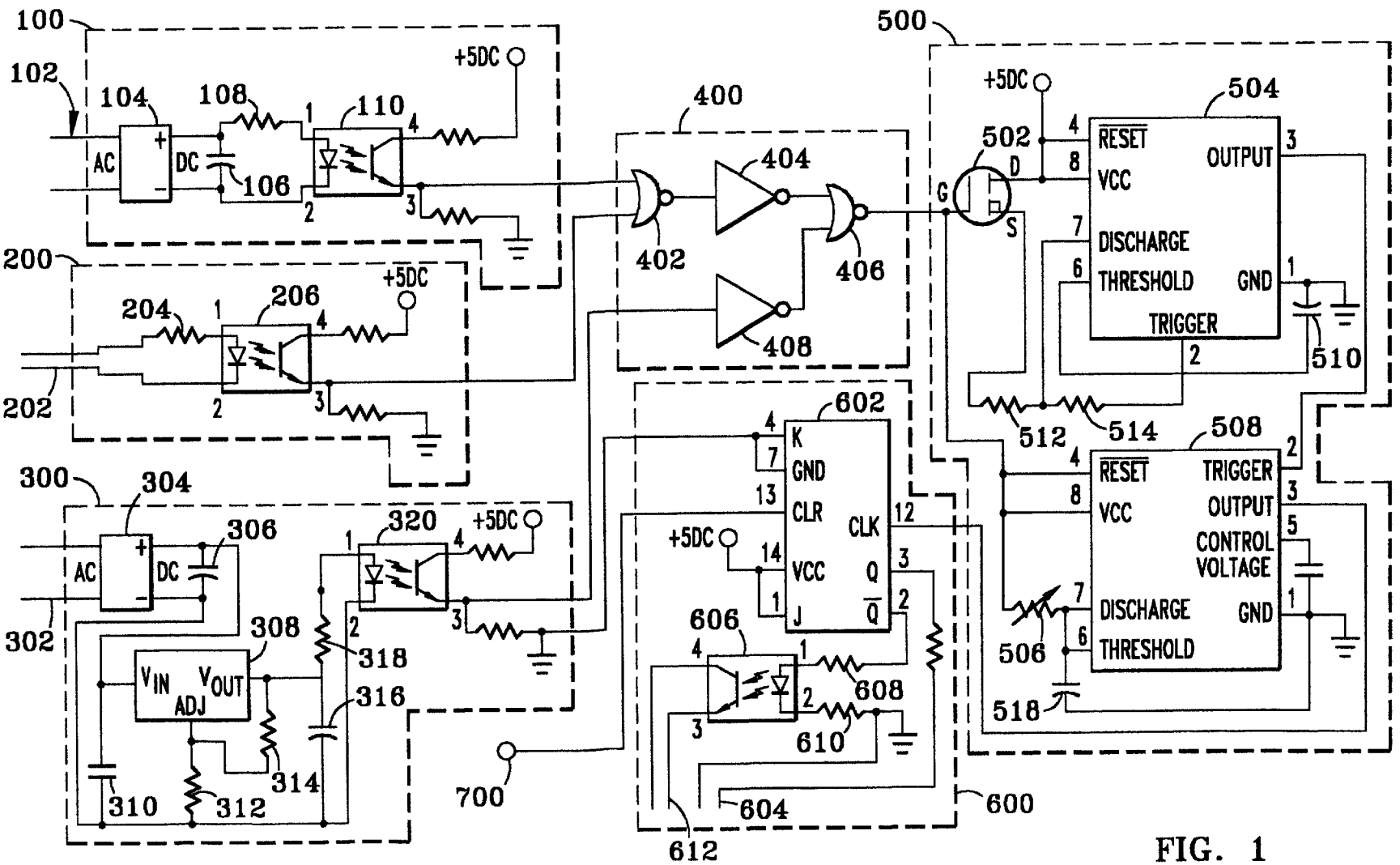
FIG. 1 is a schematic diagram of a bill validator status detector in an exemplary embodiment.

FIG. 1 is a schematic diagram of a bill validator status detector in an exemplary embodiment. The status detector is made up of six major components, a credit detector 100, a bill validator enable detector 200, a coin lockout detector 300, a logic unit 400, a delay unit 500 and an output unit 600. The credit detector 100 determines if credits are present on the machine. The credit detector 100 receives a signal at input terminal 102 from the gaming device which represents the existence of credits on the gaming device. As described herein, the status detector will not generate a failure signal until there are no credits remaining on the gaming device. The input signal at terminal 102 may be a 7 volt AC signal. The input signal is provided to a bridge rectifier 104, a filter capacitor 106 and a series resistor 108 to create a steady DC voltage drop across pins 1 and 2 of an NPN transistor optoisolator 110. When one or more credits are present on the gaming device, the AC signal at input terminal 102 is present which is converted to a DC voltage applied to optoisolator 110 which in turn generates a credit detector signal at pin 3 of the optoisolator 110. The credit detector signal is high (i.e., 5 volts) when the AC input is present at terminal 102 and low (i.e., zero volts) when the AC input is not present. The credit detector signal is provided as an input to logic unit 400.

The bill validator enable detector 200 receives a signal at input terminal 202 from the gaming device which represents the status of the bill validator. If the bill validator is operating normally, the status detector will not generate a failure signal. During normal operation, the input signal at terminal 202 is a 4–5 volt DC input. The bill validator enable detector includes a resistor 204 which generates a voltage drop across pins 1 and 2 of an NPN transistor optoisolator 206. When the DC signal is present at input terminal 202, the optoisolator 206 generates a bill validator enable signal at pin 3. The bill validator enable signal is high (i.e., 5 volts) when the DC input is present at terminal 202 and low (i.e., zero volts) when the DC input is not present. The bill validator enable signal is provided as an input to logic unit 400.

The coin lockout detector 300 receives a signal at input terminal 302 from the gaming device which represents whether the gaming device is ready for play (i.e., the previous game is finished). If the gaming device is currently in the middle of a game, the status detector will not generate a failure signal. When the gaming device is ready for play, the input signal at terminal 302 is a 24 volt AC signal. The input signal at terminal 302 is provided to a bridge rectifier 304 with a filter capacitor 306 to create a DC input voltage to a voltage regulator 308. A capacitor 310 connected to ground is used to eliminate any interference at the input to the voltage regulator 308 from the filter capacitor 306. A combination of resistor 312 and resistor 314 creates a DC voltage output from the voltage regulator 308 of approximately 5 volts. A capacitor 316 is used to provide a better transient response on the output of the voltage regulator 308. A resistor 318 between the voltage regulator 308 and optoisolator 320 generates a voltage drop across pins 1 and 2 of the NPN transistor optoisolator. When the AC signal is present at input terminal 302, the optoisolator 320 generates a coin lockout signal at pin 3. The coin lockout signal is high (i.e., 5 volts) when the AC input is present at terminal 302 and low (i.e., zero volts) when the AC input is not present. The coin lockout signal is provided as an input to logic unit 400.

The logic unit 400 includes a NOR gate 402 for receiving as inputs the credit detector signal and the bill validator enable signal. The output of NOR gate 402 is provided to inverter 404 and the output of inverter 404 is provided as one input to NOR gate 406. The coin lockout signal is provided to an inverter 408 and the output of the inverter 408 is provided as an input to NOR gate 406. The output of the logic unit 400 from NOR gate 406 is an error signal indicative of a malfunction in the bill validator which is used to initiate delay unit 500. FIG. 2 is truth table depicting the error signal generated by logic unit 400 (shown as X) where A is the credit detector signal, B is the bill validator enable signal and C is the coin lockout signal. As shown in FIG. 2, the error signal is high (e.g., 5 volts) only when the credit detector signal is low (indicating that no credits are on the gaming device), the bill validator enable signal is low (indicating that the bill validator has malfunctioned) and the coin lockout signal is high (indicating that the gaming device is ready for play). When all three conditions are met, the logic unit 400 generates a high error signal which initiates delay unit 500 as described herein. If these three conditions are not met, the logic unit 400 generates a low error signal (e.g., zero volts) which does not initiate delay unit 500.

The output from logic unit 400 is provided to a switching device 502 (e.g., a MOSFET transistor) which has one terminal coupled to a voltage source. When the output of the logic unit 400 is low, no current will flow through the switching device 502. When the output of the logic unit 400 is high, the switch 502 turns on and current will flow to an oscillator 504 as described herein. The output of the logic unit 400 is also connected to pin 4 (reset), pin 8 (Vcc) and a potentiometer 506 connected to a time delay device 508. When the output of logic unit 400 is high the time delay device 508 is turned on.

The oscillator 504 may be implemented using a 555 timer connected to the switching device 502. On oscillator 504, pin 4 (reset) and pin 8 (Vcc) are tied directly to +5 volts DC. When the output of logic unit 400 is high (i.e., an error condition is detected), current flows through the switching device 502 to charge capacitor 510 through the two resistors 512 and 514 connected to pin 2 (trigger) of the oscillator 504. Pin 6 (Threshold) and pin 2 are tied together so the oscillator 504 can trigger itself each cycle. The signal at pin 3 (output) of oscillator 504 will be a square wave. In an exemplary embodiment, the output signal from oscillator 504 is a square wave having a frequency of about 0.056Hz with each cycle lasting approximately 17.75 seconds.

The output from oscillator 504 is connected to the trigger (pin 2) of a time delay device 508 which may be implemented using a 555 timer. When the input to the trigger (pin 2) goes low the output (pin 3) goes to a logic level high and capacitor 518 charges through the potentiometer 506. Adjusting the potentiometer 506 will speed up and slow down the time it takes for the capacitor 518 to charge. When the capacitor reaches a predetermined voltage (e.g., 3.33 volts) the time delay device 508 will discharge capacitor 518 to ground. This causes pin 3 (output) of time delay device 508 to go to a logic level low. By adjusting potentiometer 506, the delay between a high output at logic unit 400 and an output by output unit 600 can be altered by the user. In an exemplary embodiment, potentiometer 506 is set to a value to provide a 30 second delay. The delay allows the status detector to accommodate false detections of a malfunction. If the output from logic unit 400 changes from high to low during the delay period (indicating that the bill validator is now working properly) the output unit 600 will not generate error outputs described herein.

The delay signal from the output of the time delay device 508 is connected to the clock (pin 12) of a storage device 602 in output unit 600. In an exemplary embodiment, the storage device is a negative edge triggered J-K flip-flop. Pin 4 (K) and pin 7 (ground) are 20 connected to ground. Pin 1 (J) and pin 14 (Vcc) are connected to +5 volts DC. When the delay signal from delay unit 500 goes from a logic level high to a logic level low, the output on pin 3 (Q) is set to a logic level high and the output on pin 2 (Q bar) is set to a logic level low. The Q and Q bar outputs remain in this state until pin 13 (reset) receives a logic level high. A reset terminal 700 is used to provide a logic high to pin 13 (reset) of the storage device 602 through a user activated switch (not shown). The service personnel may activate a switch at the gaming device to connect the reset terminal 700 to a voltage source to reset storage device 602. After a logic high is applied to the reset pin of storage device 608, pin 3 (Q) and pin 2 (Q bar) go to a logic level low and high respectively.

The output of pin 3 (Q) of storage device 602 is connected to one pin of a two pin output port 604. The other pin on the output port 604 is connected to ground. The output signal at output port 604 may be used to provide an indication that the bill validator has malfunctioned. In an exemplary embodiment, a lamp (e.g., light emitting diode) is mounted on the top of the gaming device and is activated when a high output signal is provided on output port 604.

Pin 2 (Q bar) of storage device 602 is connected to pin 1 of an NPN transistor optoisolator 606 through a resistor 608. Pin 2 of the optoisolator 606 is connected to ground through a resistor 610. The optoisolator 606 is active when Q bar is at a logic high level, and is not active when Q bar is at a logic low level. When the optoisolator 606 is active, the emitter (pin 3) and the collector (pin 4) will allow current to flow. The optoisolator 606 provides a switch which selectively changes states to either provide or interrupt continuity between pins 3 and 4. Pin 3 and pin 4 are connected to a 2 pin monitor port 612. The monitor port 612 may be connected to a monitoring system which records when gaming devices have malfunctioned. The monitoring system can keep a record of all bill validator failures and use this data to schedule maintenance of bill validators including replacement of bill validators having unacceptable failure rates.

While exemplary embodiments have been shown and described, various modifications and substitutions may be made thereto without departing from the spirit and scope of the invention. Accordingly, it is to be understood that the present invention has been described by way of illustration and not limitation.

What is claimed is:

1. A system for detecting the status of a bill validator in a gaming device, the system comprising:

a credit detector for receiving a signal from the gaming device and generating a credit detector signal indicating whether the gaming device has one or more credits;

a bill validator enable detector for receiving a signal from the gaming device and generating a bill validator enable signal indicating the status of the bill validator;

a coin lockout detector for receiving a signal from the gaming device and generating a coin lockout signal indicating whether the gaming device is ready for play; and a logic unit for generating an error signal indicative of a malfunction in the bill validator in response to said credit detector signal, said bill validator enable signal and said coin lockout signal.

2. The system of claim 1 further comprising:

a delay unit for receiving said error signal and generating a delayed signal a predetermined time after receiving said error signal; and, an output unit for generating an output signal in response to said delayed signal.

3. The system of claim 1 wherein:

said logic unit includes a first NOR gate for combining said credit detector signal and said bill validator enable signal to generate a first signal;

a first inverter for receiving said first signal and generating an inverted first signal;

a second inverter for receiving said coin lockout signal and generating an inverted coin lockout signal; and a second NOR gate for combining said inverted first signal and said inverted coin lockout signal to generate said error signal.

4. The system of claim 2 wherein said delay unit includes:

a switch coupled to a voltage source, said switch responsive to said error signal;

an oscillator coupled to said switch, said switch initiating said oscillator by connecting said oscillator to said voltage source, said oscillator generating an oscillating signal; and a time delay device for generating said delayed signal in response to said oscillating signal.

5. The system of claim 2 wherein said output unit includes:

a storage device for storing said output signal.

6. The system of claim 2 wherein said output unit includes:

a switch responsive to said output signal, said switch being conductive when said output signal has a first value and non-conductive when said output signal has a second value.

7. The system of claim 6 further comprising:

a monitor system coupled to said switch, said monitor system recording instances of bill validator failure.

8. The system of claim 2 further comprising:

a visual indicator responsive to said output signal.

9. The system of claim 8 wherein:

said visual indicator is a light emitting diode.

* * * * *

UNITED STATES PATENT AND TRADEMARK OFFICE

CERTIFICATE OF CORRECTION

PATENT NO. : 6,247,572 B1
DATED : June 19, 2001
INVENTOR(S) : Neborsky et al.

It is certified that error appears in the above-identified patent and that said Letters Patent is hereby corrected as shown below:

Column 3,
Line 58, delete "608" and insert therefor -- 602 --.

Signed and Sealed this

Twenty-eighth Day of December, 2004

JON W. DUDAS
*Director of the United States Patent and Trademark Office*